US008655255B2

(12) United States Patent
Ichikawa

(10) Patent No.: US 8,655,255 B2
(45) Date of Patent: Feb. 18, 2014

(54) SHEET CONVEYER DEVICE AND IMAGE FORMING APPARATUS

(75) Inventor: Hiroshi Ichikawa, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1 day.

(21) Appl. No.: 13/362,442

(22) Filed: Jan. 31, 2012

(65) Prior Publication Data

US 2012/0237279 A1 Sep. 20, 2012

(30) Foreign Application Priority Data

Mar. 14, 2011 (JP) ..... 2011-055744

(51) Int. Cl.
*G03G 15/00* (2006.01)
*B65H 5/00* (2006.01)
*B65H 3/06* (2006.01)

(52) U.S. Cl.
USPC ..... 399/388; 399/392; 271/10.11; 271/117; 271/118

(58) Field of Classification Search
CPC ..... B65H 3/0684; B65H 11/00; B65H 11/02
USPC ..... 399/392
See application file for complete search history.

(56) References Cited

U.S. PATENT DOCUMENTS

| | | | | |
|---|---|---|---|---|
| 7,461,840 | B2 | 12/2008 | Hattori | |
| 2006/0180986 | A1 | 8/2006 | Hattori | |
| 2006/0267269 | A1 * | 11/2006 | Yano et al. | 271/127 |
| 2009/0008868 | A1 | 1/2009 | Kuroda | |

FOREIGN PATENT DOCUMENTS

| | | |
|---|---|---|
| JP | 06-219573 | 8/1994 |
| JP | 2006-176321 | 7/2006 |
| JP | 2008-174390 | 7/2008 |

OTHER PUBLICATIONS

Search Report and the Search Opinion in corresponding European Patent Application No. 12150885.7 mailed Jun. 25, 2013.

* cited by examiner

*Primary Examiner* — Matthew G MaArini
*Assistant Examiner* — John M Royston
(74) *Attorney, Agent, or Firm* — Banner & Witcoff, Ltd.

(57) ABSTRACT

A sheet conveyer device is provided. The sheet conveyer device includes a sheet tray, a feeder roller, a separator roller, a roller holder to rotatably support the feeder roller and to be coupled with the separator roller, spreading from a separator roller side toward a feeder roller side, to be movable between a first position and a second position, a manipulation arm configured to be coupled to the roller holder and to manipulate the roller holder to move between the first position and the second position, and a driving unit to drive the manipulation arm to move the roller holder. The manipulation arm is coupled to the roller holder at a coupled section, which is in a position between the feeder roller and the separator roller and in a position between two tangent planes which are common to the feed roller and the separator roller.

10 Claims, 8 Drawing Sheets

SHEET CONVEYER DEVICE AND IMAGE FORMING APPARATUS

CROSS REFERENCE TO RELATED APPLICATION

This application claims priority from Japanese Patent Application No. 2011-055744, filed on Mar. 14, 2011, the entire subject matter of which is incorporated herein by reference.

BACKGROUND

1. Technical Field

An aspect of the present invention relates to a sheet conveyer device and an image forming apparatus having a sheet conveyer device.

2. Related Art

A sheet conveyer device to convey a sheet along a conveying path is known. In the sheet conveyer device, for example, a sheet-feeder roller and a sheet-separator roller may be held in a piece of roller holder. The roller holder may be coupled with a manipulation arm via a boss, which is formed to protrude upwardly from an upper plane of the roller holder, to be swingable in order to move the sheet-feeder roller vertically.

SUMMARY

While the roller holder is thus vertically movable via the manipulation arm, with the boss protruding upward, it is required that the sheet conveyer device reserves an empty space as a movable range for the roller holder and for the boss. Therefore, it may be difficult to reduce a volume of the sheet conveyer device in a vertical direction, i.e., a direction of movement for the roller holder.

In view of the difficulty, the present invention is advantageous in that a sheet conveyer device, which can be downsized, is provided.

According to an aspect of the present invention, a sheet conveyer device, which is configured to convey a sheet in a predetermined sheet conveying direction along a sheet conveying path, is provided. The sheet conveyer device includes a sheet tray, in which the sheet is stored in a stack along a direction of thickness of the sheet, a feeder roller, which is configured to rotate in a position to contact the sheet and feed the sheet in the sheet conveying path, a separator roller, which is arranged in a downstream position along the sheet conveying direction with respect to the feeder roller and configured to separate the fed sheet from the stack of sheets, a roller holder, which is configured to rotatably support the feeder roller and to be coupled with the separator roller; configured to spread from a separator roller side toward a feeder roller side over the separator roller and the feeder roller; and configured to be movable between a first position, in which the feeder roller is in contact with the sheet in the sheet tray, and a second position, in which the feeder roller is apart from the sheet tray, a manipulation arm, which is configured to extend in a direction parallel with an axial direction of the feeder roller; configured to be coupled to the roller holder; and configured to manipulate the roller holder to move between the first position and the second position, and a driving unit, which is configured to drive the manipulation arm to move the roller holder. The manipulation arm is coupled to the roller holder at a coupled section, which is in a position between the feeder roller and the separator roller and in a position between two tangent planes which are common to the feed roller and the separator roller.

According to another aspect of the present invention, an image forming apparatus is provided. The image forming apparatus includes a sheet conveyer device, which is configured to convey a sheet in a predetermined sheet conveying direction along a sheet conveying path, and an image forming unit, which is configured to form an image on the sheet being conveyed in the sheet conveying path by the sheet conveyer device. The sheet conveyer device includes a sheet tray, in which the sheet is stored in a stack along a direction of thickness of the sheet, a feeder roller, which is configured to rotate in a position to contact the sheet and feed the sheet in the sheet conveying path, a separator roller, which is arranged in a downstream position along the sheet conveying direction with respect to the feeder roller and configured to separate the fed sheet from the stack of sheets, a roller holder, which is configured to rotatably support the feeder roller and to be coupled with the separator roller; configured to spread from a separator roller side toward a feeder roller side over the separator roller and the feeder roller; and configured to be movable between a first position, in which the feeder roller is in contact with the sheet in the sheet tray, and a second position, in which the feeder roller is apart from the sheet tray, a manipulation arm, which is configured to extend in a direction parallel with an axial direction of the feeder roller; configured to be coupled to the roller holder; and configured to manipulate the roller holder to move between the first position and the second position, and a driving unit, which is configured to drive the manipulation arm to move the roller holder. The manipulation arm is coupled to the roller holder at a coupled section, which is in a position between the feeder roller and the separator roller and in a position between two tangent planes which are common to the feed roller and the separator roller.

BRIEF DESCRIPTION OF THE ACCOMPANYING DRAWINGS

DETAILED DESCRIPTION

Hereinafter, an embodiment of the present invention will be described with reference to the accompanying drawings.

1. Overall Configuration of the Image Forming Apparatus

Figure 1:
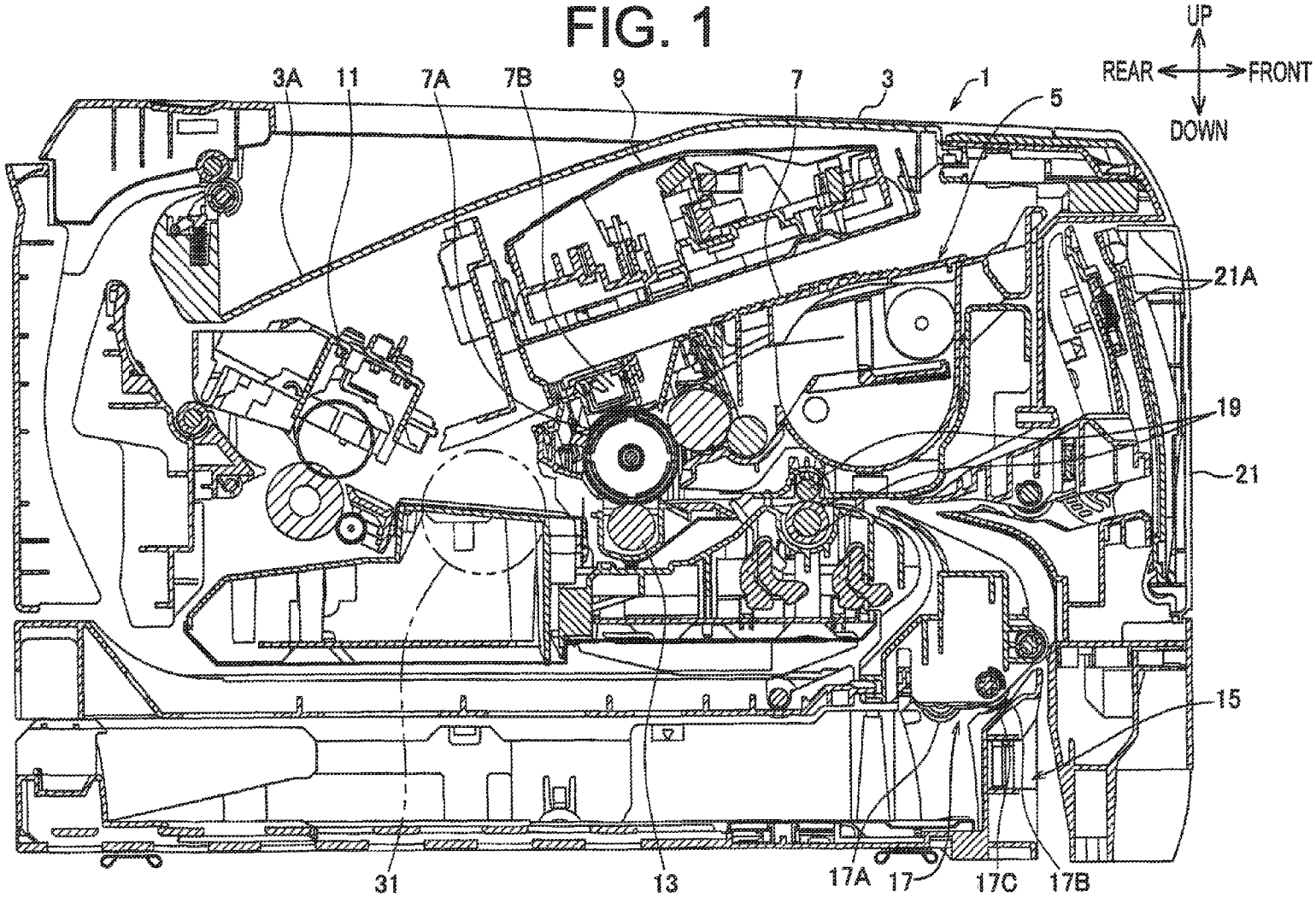
FIG. 1 is a cross-sectional side view of an image forming apparatus 1 according to an embodiment of the present invention.

An overall configuration of the image forming apparatus 1 according to the embodiment will be described with reference to FIG. 1 in the present embodiment described below, directions concerning the image forming apparatus 1 will be referred to based on a user's position to ordinarily use the image forming apparatus 1 and in accordance with orientation indicated by arrows in each drawings. That is, for example, a viewer's right-hand side appearing in FIG. 1 is referred to as a front side of the image forming apparatus 1. A left-hand side in FIG. 1 opposite from the front is referred to as rear. The front-rear direction of the image forming apparatus 1 may also be referred to as a direction of depth. A side, which corresponds to the viewer's nearer side is referred to as a left-side face, and an opposite side from the left, which corresponds to the viewer's further side, is referred to as a right-side face. The right-left direction of the image forming apparatus 1 may also be referred to as a widthwise direction. The up-down direction in FIG. 1 corresponds to a vertical direction of the image forming apparatus.

The image forming apparatus has a chassis 3, and an image forming unit 5 is contained in the chassis 3. The image forming unit 5 forms an image in a developer agent and transfers the image in the developer agent to a recording medium, which is, for example, a sheet of paper and an OHP sheet, as the recording sheet flows in a predetermined conveying direction. The image forming unit 5 includes a processing cartridge 7, an exposure device 9, and a fixing unit 11.

The processing cartridge 7 includes a photosensitive drum 7A, which carries the developer agent image, a charger 7B, which electrically charges the photosensitive drum 7A, and a transfer roller 13, which transfers the developer agent image on the photosensitive drum 7A to the recording sheet. The transfer roller 13 is arranged in a position to face the photosensitive drum 7A.

The image transferred onto the recording sheet is heated and thermally fixed thereat by the fixing device 11. The recording sheet passing through the fixing unit 11 is directed upward and carried to be discharged in a discharge tray 3A, which is formed in an upper surface of the chassis 3.

In an upstream position with respect to the photosensitive drum 7A along the conveying direction, a sheet-feed tray 15 is removably installed in the chassis 3. In the sheet-feed tray 15, the recording sheets to be carried to the photosensitive drum 7A and to the discharge tray 3A are stored in a stack along a direction of thickness. The recording sheets are picked up one-by-one and conveyed toward register rollers 19 by a feeder 17.

The feeder 17 includes a pickup roller 17A, a separator roller 17B, and a separator pad 17C. The pickup roller 17A picks up a topmost recording sheet amongst the recording sheets stacked in the sheet-feed tray 15 and forwards the picked-up recording sheet toward the register rollers 19. The separator roller 17B and the separator pad 17C separate the topmost recording sheet from the stack of recording sheets and forward the separated recording sheet toward the register rollers 19.

In the present embodiment, the register rollers 19 are arranged in upstream positions with respect to the photosensitive drum 7A along the conveying direction. The register rollers 19 serve as conveyer rollers, which adjust timings for feeding the recording sheet to the photosensitive drum 7A and correct an orientation of the recording sheet to be conveyed to the photosensitive drum 7A. However, the register rollers 19 may not necessarily serve to adjust timings and correct the orientation at a same time, but the register rollers 19 may serve to solely adjust timings or correct the orientation.

2. Structure of Sheet Conveyer

Structure of a sheet conveyer 23 according to the embodiment of the present invention will be described with reference to FIG. 2. On a front face of the chassis 3, a front cover 21 to cover and expose an opening 3B and a sheet-inlet 3C is provided. The front cover 21 is pivotably attached to the chassis 3 to be movable between an open position (see FIG. 2) and a closed position (see FIG. 1).

The opening 3B allows a user to access the internal structure inside the chassis 3. Therefore, whilst the processing cartridge 7 is removably installable in the chassis 3, the user can remove and install the processing cartridge 7 when the front cover 1 is open. Further, the user can access the recording sheet when the recording sheet is jammed in a first conveying path L1 to remove when the front cover 1 is open. The sheet inlet 3C is an opening, through which recording sheets are externally inserted in the chassis 3.

An inner side of the front cover 21, which is closer to the image forming unit 5 when the front cover 21 is in the closed position, is formed to serve as a cover tray 21A. When the front cover 21 is in the open position to expose the sheet inlet 3C, the recording sheets to be externally inserted in the image forming apparatus 1 are placed on the cover tray 21A.

Figure 3:
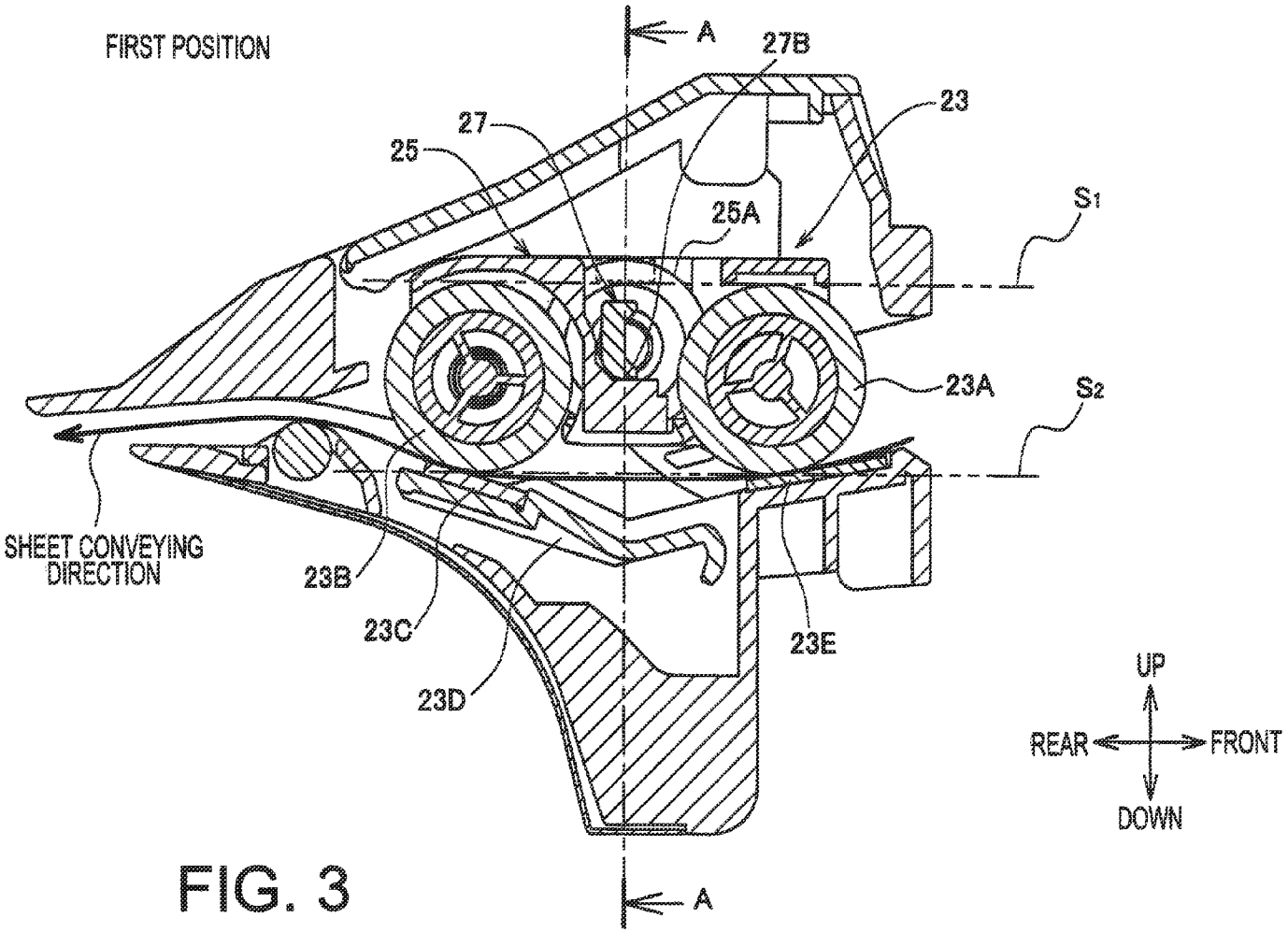
FIG. 3 is a cross-sectional view of a sheet conveyer according to the embodiment of the present invention with a roller holder being in a first position.

The recording sheets stacked on the cover tray 21A are picked up and separated from the stack to be forwarded toward the register rollers 19 by a sheet conveyer 23 one-by-one (see FIG. 3). The sheet conveyer 23 is arranged in a downstream position with respect to the sheet inlet 3C along a second conveying path L2, which ranges from the cover tray 21A to the photosensitive drum 7A. The sheet conveyer 23 includes a pickup roller 23A, a separator roller 23B, and a separator pad 23C.

The pickup roller 23A is a feeder roller, which picks up a topmost recording sheet amongst the recording sheets stacked on the cover tray 21A in a position to contact the topmost recording sheet and forwards the picked-up recording sheet toward the separator roller 23B. The separator roller 23B contacts the topmost recording sheet forwarded from the pickup roller 23A on a top surface and applies conveying force to the topmost recording sheet.

The separator roller 23B is arranged in a downstream position with respect to the pickup roller 23A along the conveying direction. The separator roller 23B is arranged in an orientation to have an axis thereof to be in parallel with an axial direction of the pickup roller 23. A diameter of the separator roller 23A is same as a diameter of the pickup roller 23A. The axes of the separator roller 23B and the pickup roller 23A extend in parallel with the direction of width of the image forming apparatus 1.

The separator pad 23C is arranged in a position to face the separator roller 23B and contacts a lower surface of the recording sheet to apply convey resistance to the recording sheet from below. The separator pad 23C is held by a pad holder 23D and movable to be close to and apart from the separator roller 23B; yet, the separator pad 23C is resiliently urged toward the separator pad 23B by a resilient member (not shown) such as a coil spring via the pad holder 23D.

When the separator roller 23B rotates, the recording sheet being in contact with the separator roller 23B is forwarded toward the register rollers 19, which is in the downstream position along the conveying direction. Meanwhile, the recording sheet being in contact with the separator pad 23C is held at the position by the convey resistance. Accordingly, a plurality of recording sheets picked up by the pickup roller 23A are separated, and solely the topmost recording sheet is forwarded toward the register rollers 19.

Additionally, in the present embodiment, a friction pad 23E is provided in a position to face the pickup roller 23A. Therefore, feeding a plurality of recording sheets in the second conveying path L2 is prevented even more effectively.

Figure 5A:
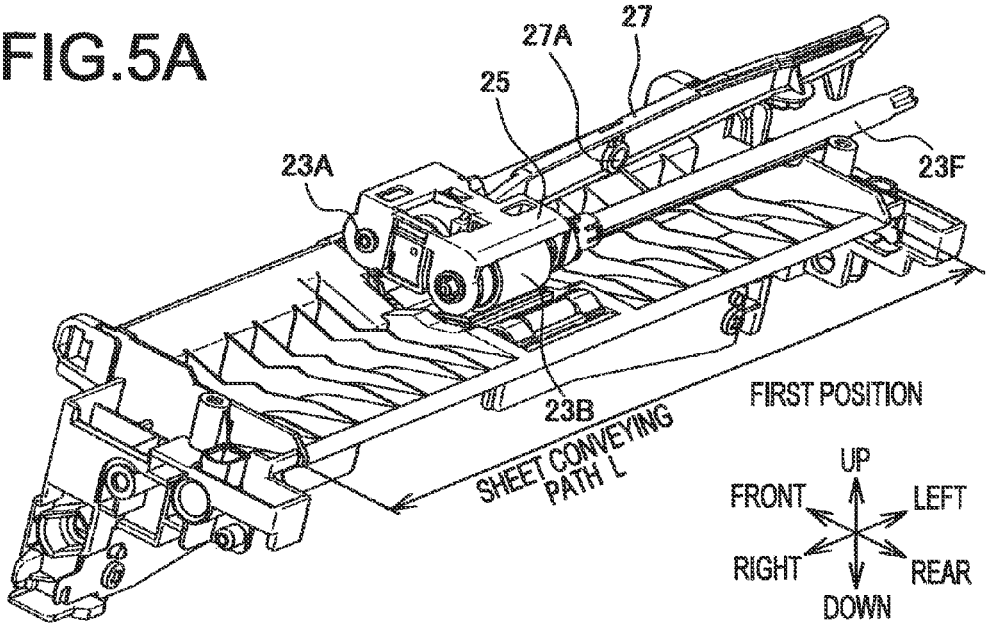
FIG. 5A is a perspective view of the sheet conveyer according to the embodiment of the present invention with the roller holder being in the first position.
Figure 5B:
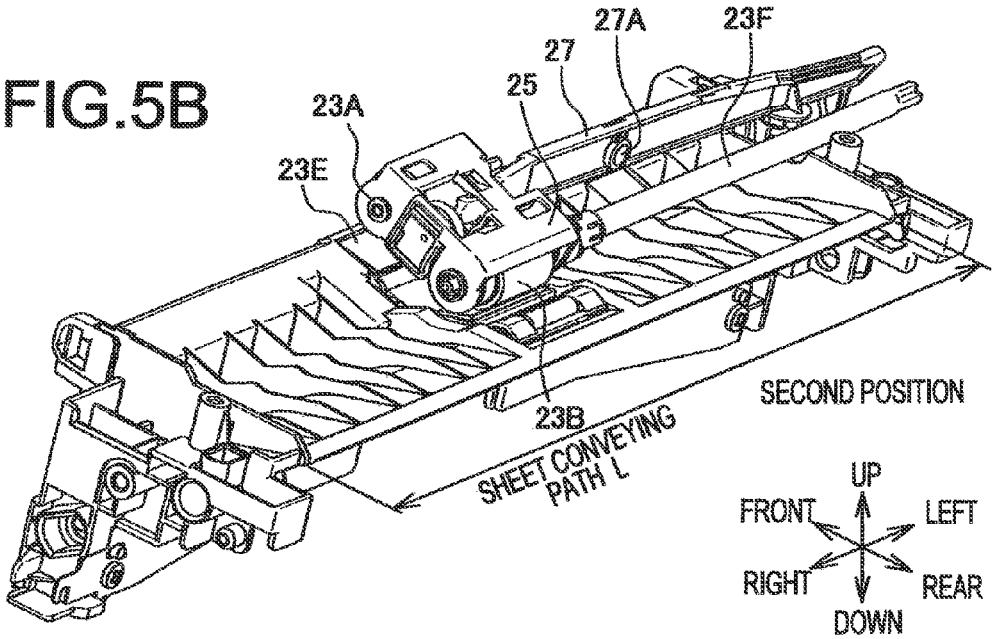
FIG. 5B is a perspective view of the sheet conveyer according to the embodiment of the present invention with the roller holder being in the second position.

The pickup roller 23A is rotatably supported by a roller holder 25 (see FIGS. 5A, 5B) at axial ends thereof, and the roller holder 25 is coupled with the separator roller 23B. The roller holder 25 is swingable about an axis of a drive shaft 23F, which transmits driving force to the separator roller 25, along with at least the pickup roller 23A. The roller holder 25 spreading from the separator roller side (i.e., rear) toward the pickup roller side (i.e., front) hangs over the separator roller 23B and the pickup roller 23A.

The separator roller 23B with the roller holder 25 coupled therewith is rotatably supported by a frame (not shown), which extends in the widthwise direction being parallel with the axis of the drive shaft 23F, and is rotatable along with the drive shaft 23F.

Figure 4:
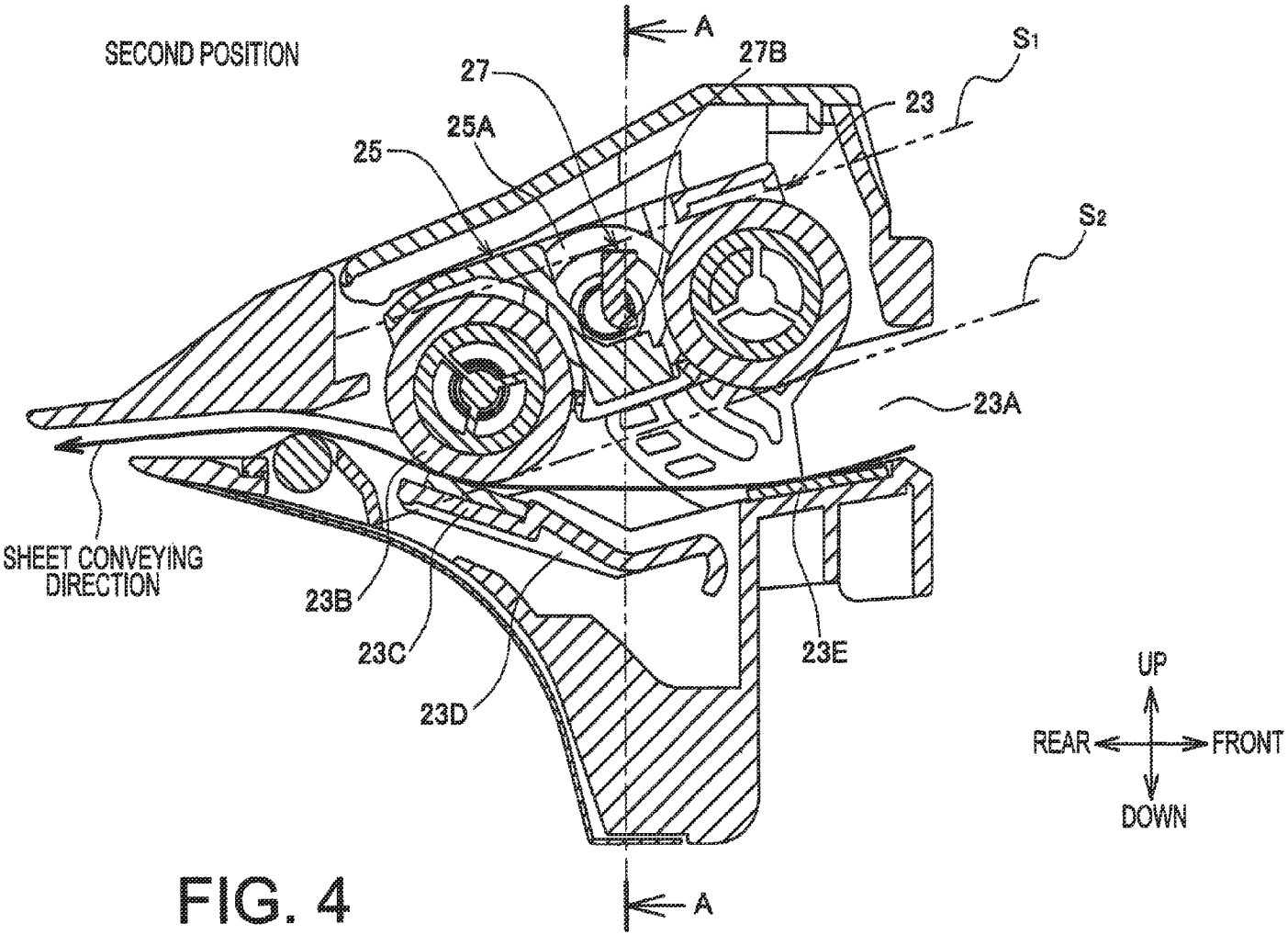
FIG. 4 is a cross-sectional view of the sheet conveyer according to the embodiment of the present invention with a roller holder being in a second position.

Therefore, when the roller holder 25 swings about the drive shaft 23F, the pickup roller 23A moves between a first position (see FIG. 3), in which the pickup roller 23A can contact the recording sheet on the cover tray 21A, and a second position (see FIG. 4), in which the pickup roller 23A is apart from the cover tray 21A.

The sheet conveyer 23 further includes a manipulation arm 27, which manipulates the roller holder 25 to move from the first position to the second position, and vice versa. The manipulation arm 27 extends from one of widthwise ends (e.g., a left side end) of the chassis 3 toward the other one of widthwise ends (e.g., a right side end) to a widthwise midst position.

Figure 6A:
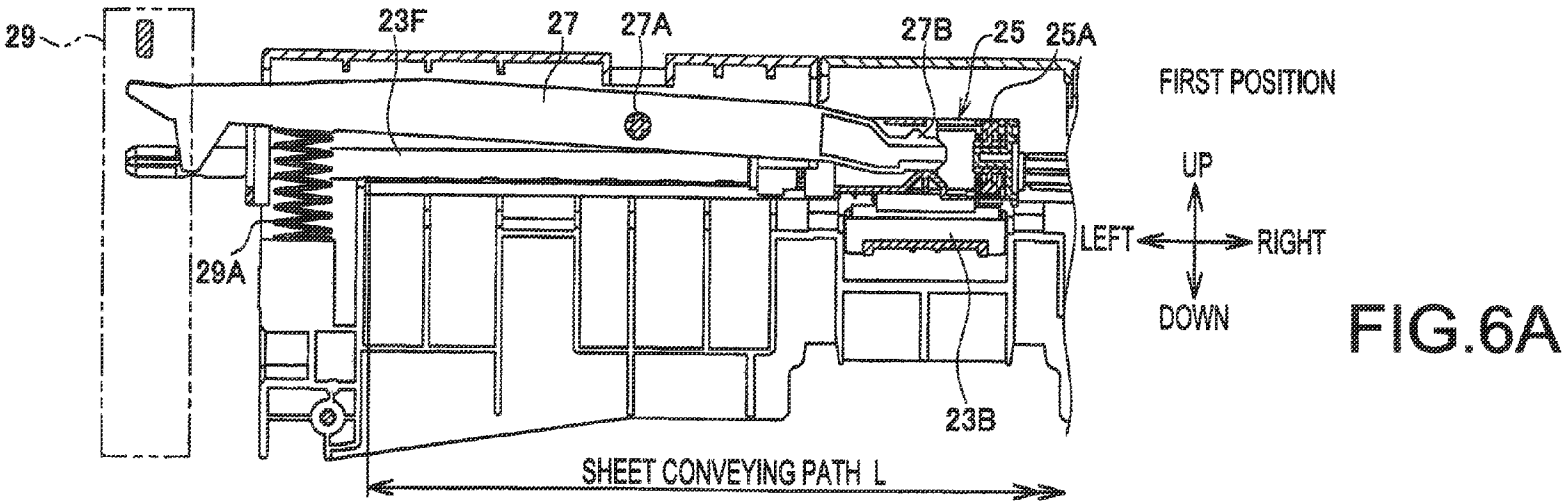
FIG. 6A is a cross-sectional view of the sheet conveyer according to the embodiment of the present invention taken from a line A-A in FIG. 3.
Figure 6B:
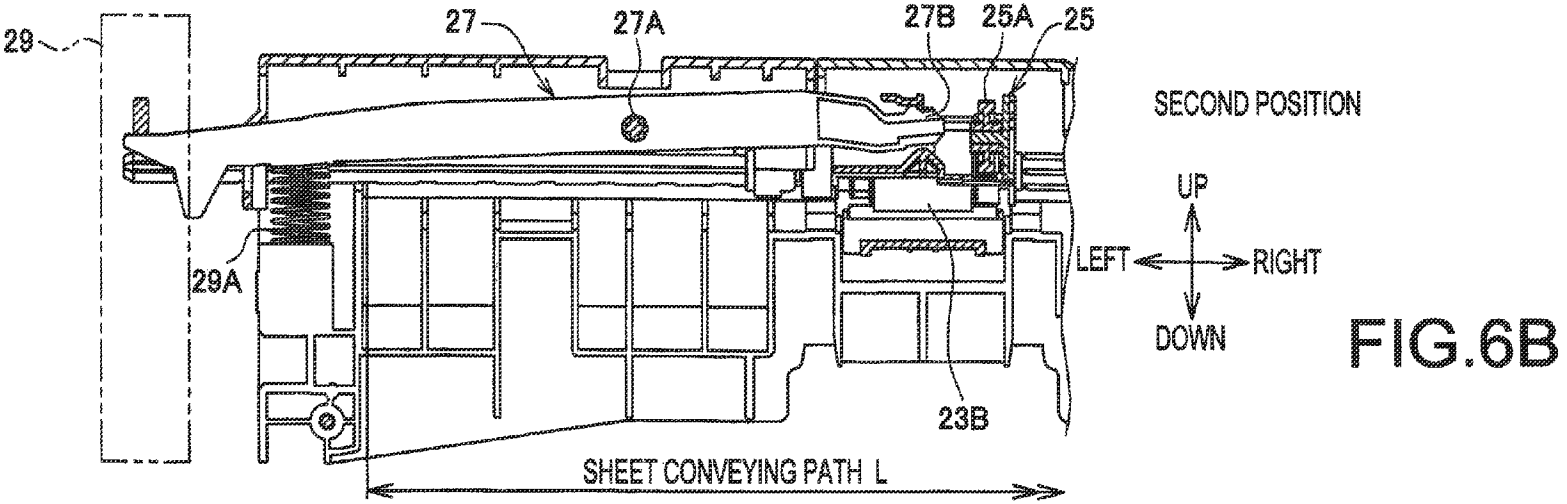
FIG. 6B is a cross-sectional view of the sheet conveyer according to the embodiment of the present invention taken from a line A-A in FIG. 4.

Thus, the manipulation arm 27 is coupled to the roller holder 25 at one longitudinal end and extends over a part of a range of the sheet conveying path L, whilst the other longitudinal end of the manipulation arm 27 extends beyond the sheet conveying path L (see FIGS. 6A, 6B). Further, the manipulation arm 27 is swingably supported by a swing axis 27A, which is arranged in a position corresponding to the sheet conveying path L.

The swing axis 27A being in the position corresponding to the sheet conveying path L refers to the swing axis 27A falling within the range of the sheet conveying path L when, for example, the sheet conveying path L is viewed from above (e.g., in a plane view). Moreover, the swing axis 27A is supported in a frame (not shown) extending in the widthwise direction similarly to the separator roller 23B.

Figure 7:
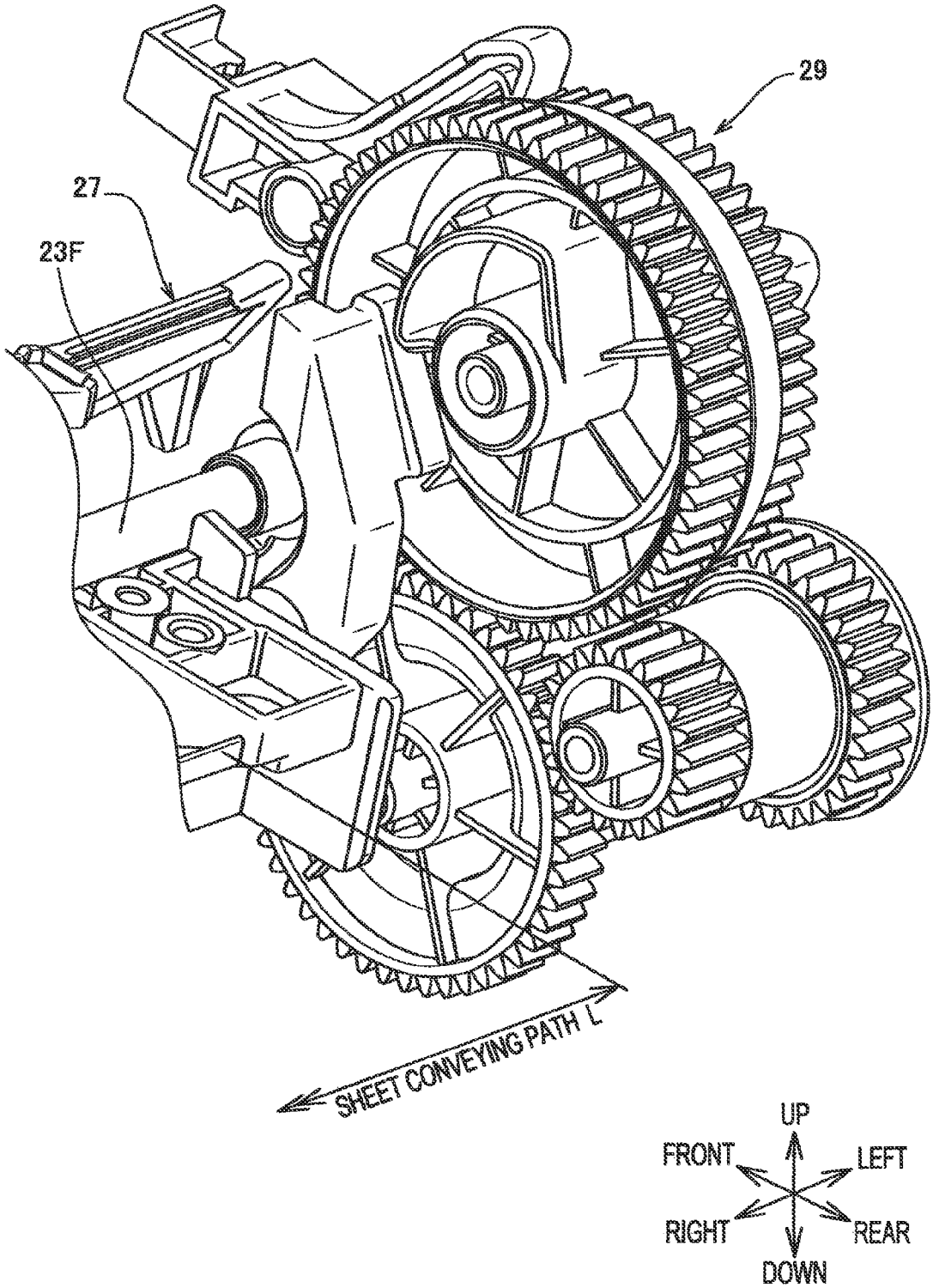
FIG. 7 is a perspective view of a driving unit in the sheet conveyer according to the embodiment of the present invention.

In a position outside the range of the sheet conveying path L, a driving unit 29 (see FIG. 7) is arranged. The driving unit 29 applies driving force supplied from a motor 31 (see FIG. 1) to the manipulation arm 27 in order to move the roller holder 25. The motor 31 generates rotation force for rollers including the drive shaft 23F (the separator roller 23B) and the pickup roller 17A. Behaviors of the driving unit 29 will be briefly described below.

In a position outside the range of the sheet conveying path L along the widthwise direction, and in a position closer to the sheet conveying path L with respect to the driving unit 29, a coil spring 29A (see FIGS. 6A, 6B) is provided. The coil spring 29A applies resilient force to the manipulation arm 27 to place the manipulation arm 27 in the first position (FIG. 6A).

When no recording sheet is fed in the sheet conveying path L, the driving unit 29 presses one of the longitudinal ends outside the range of the sheet conveying path L (e.g., the left-side end) of the manipulation arm 27 downward to compress the coil spring 29A (FIG. 6B). When the recording sheet is fed in the sheet conveying path L, the driving unit 29 releases the coil spring 29A in order to place the manipulation arm 27 and the pickup roller 23A in the first position (FIG. 6A).

The pickup roller 23A is driven by the driving force, which is transmitted by the drive shaft 23F via a gear 25A (see FIG. 8) in the roller holder 25. The gear 25A is arranged in a position opposite from the drive shaft 23F across the separator roller 23B. In the present embodiment, therefore, the drive shaft 23F is arranged on the left-hand side with respect to the separator roller 23B, and the gear 25F is arranged on the right-hand side with respect to the separator roller 23B.

It is to be noted that the driving force from the drive shaft 23F may be transmitted to the pickup roller 23A with or without additional intervening gears other than the gear 25A. For example, an additional gear to be engaged with the gear 25A and to rotate along with the drive shaft 23F may be provided to the drive shaft 23F. For another example, an additional gear to be engaged with the gear 25A may be provided to an axial end of the separator roller 23B. In the present embodiment, the driving force is transmitted to the pickup roller 23A via the gear 25A and the latter additional gear.

A coupled section 27B (see FIG. 3), in which the manipulation arm 27 and the roller holder 25 are coupled to each other, is provided in a position between the pickup roller 23A and the separator roller 23B, and in a position between two tangent planes S1, S2, which are common to the pickup roller 23A and the separator roller 23B. In this regard, the position between tangent planes S1, S2 includes positions on the tangent planes S1, 52. The coupled section 27B stays in the position between the tangent planes S1, S2 at all times regardless of the positions of the roller holder 25 even when the roller holder 25 swings (see FIG. 4).

In other words, the swing movement of the manipulation arm 27 in a direction to intersect the tangent plane S2 (e.g., vertically) shifts the pickup roller 23A between the first position and the second position; however, with the pickup roller 23A being in any position in and between the first position and the second position, the coupled section 27B falls in the position between the two tangent plane S1 and S2.

When the roller holder 25 is in the first position, in which the pickup roller 23A is in the position to be in contact with the recording sheet, the manipulation arm 27 urges the roller holder 25 along with the pickup roller 23A at a widthwise midst position (see FIG. 8) of the pickup roller 23A toward the cover tray 21A (e.g., downwardly).

3. Features of the Image Forming Apparatus and the Sheet Conveyer

In the present embodiment, as has been described above, the coupled section 27B, in which the roller holder 25 and the manipulation arm 27 are coupled to each other, is set in the position between pickup roller 23A and the separator roller 23B and in the position between the common tangent planes S1 and S2. Thus, it is prevented that the coupled section 27B protrudes from the roller holder 25. Rather, without a boss protruding upward from the top surface of the roller holder 25, the coupled section 27B stays within the roller holder 25 at all times. Therefore, a room required for the roller holder to move in the chassis 3 may be reduced. In other words, the sheet conveyer 23 which can be easily downsized may be provided.

In the present embodiment, the roller holder 25 is coupled with the separator roller 23B. In other words, the separator roller 23B is rotatably held in the roller holder 25. If the separator roller 23B is held in a different roller holder, the separator roller 23B and the pickup roller 23A are treated independently from each other. In such a configuration, processes for assembling the sheet conveyer 23 may be increased, and efficiency in maintenance of the sheet conveyer 23 may be lowered. According to the present embodiment, however, with the roller holder 25 holding the separator roller 23B and the pickup roller 23A, the separator roller 23B and the pickup roller 23A may be handled as a piece of roller assembly. Therefore, processes for manufacturing the sheet conveyer 23 may be reduced, and efficiency in maintenance of the sheet conveyer may be improved.

In the present embodiment, the manipulation arm 27 is movable in the direction to intersect the tangent plane S2. Therefore, a distance between the pickup roller 23A and the separator roller 23B may be reduced to be smaller compared to a distance between the pickup roller and the separator roller in a sheet conveyer with a manipulation arm movable in parallel with the tangent plane S2. That is, if the manipulation arm 27 is movable in a direction parallel with the tangent plane S2 when the roller holder 25 is in the first position, the distance between the pickup roller 23A and the separator roller 23B is required to be greater than a movable (stroke) range of the manipulation arm 27. Thus, a smallest distance between the pickup roller 23A and the separator roller 23B is limited and may not be as small as the distance between the pickup roller 23A and the separator roller 23B in the present embodiment. Meanwhile, in the present embodiment with the manipulation arm 27 movable in the direction to intersect the tangent plane S2, the distance between the pickup roller 23A and the separator roller 23B is not necessarily affected by the stroke range of the manipulation arm 27. Therefore, according to the present embodiment, the sheet conveyer 23, which can be downsized by shortening the distance between the pickup roller 23A and the separator roller 23B, may be provided. According to the embodiment, it is to be noted that the tangent planes S1, S2 may not necessarily be in parallel with each other.

Figure 8:
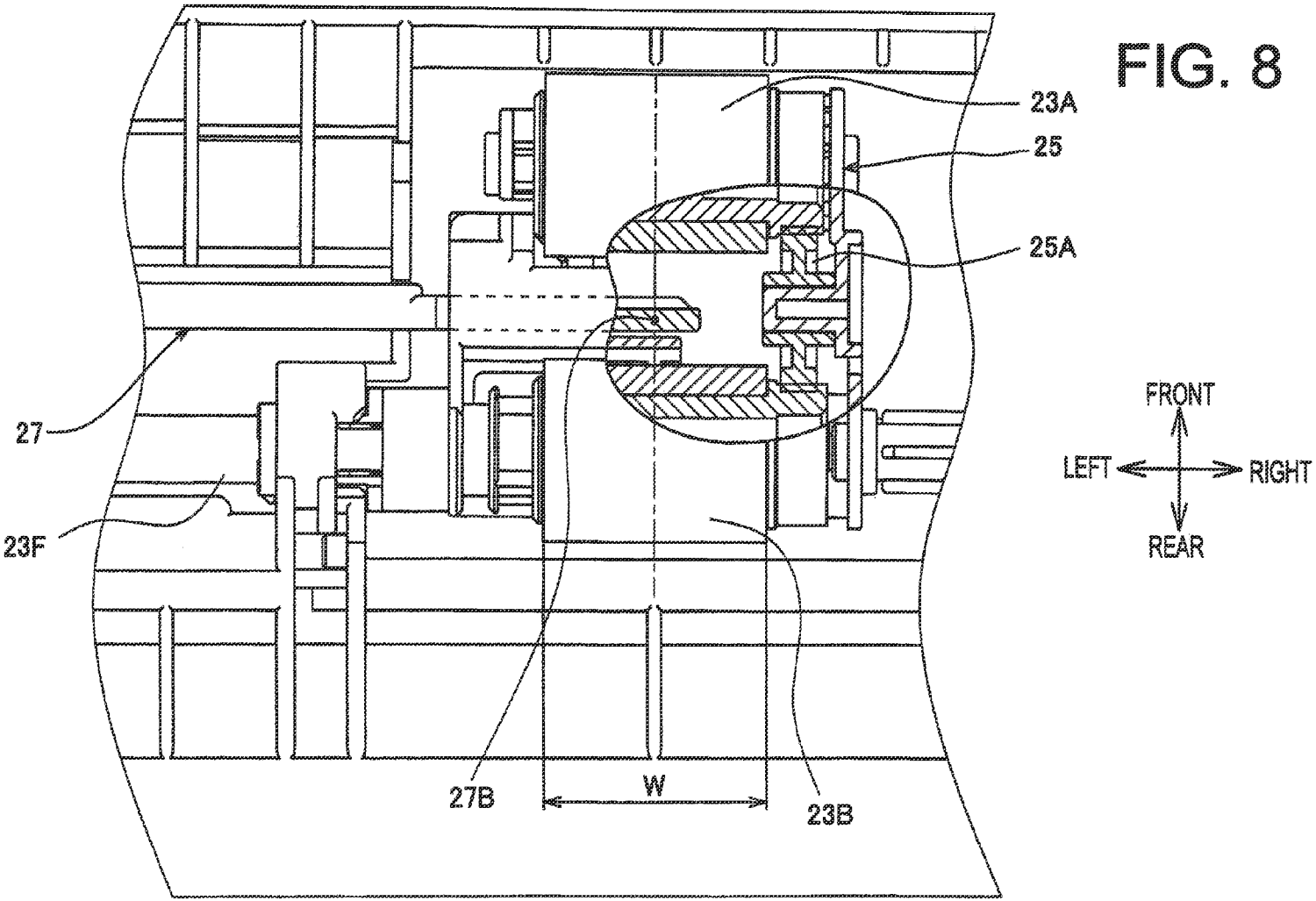
FIG. 8 is a bottom plane view with a partially cross-sectional view of the sheet conveyer according to the embodiment of the present invention.

According to the present embodiment, when the roller holder 25 is in the first position, the manipulation arm 27 applies pressure to the roller holder 25 at a section corresponding to an axial midst position of the pickup roller 23A (see FIG. 8). Therefore, the pickup roller 23A urged against the recording sheet can be evenly and stably in contact with the recording sheet. Thus, the recording sheet can be stably fed in the sheet conveying path L. More specifically, the coupled section 27B is in a midst position in a width W (see FIG. 8) of the pickup roller 23A; therefore, the pressure applied to the pickup roller 23A is evenly distributed in the width W of the pickup roller 23A. Thus, the recording sheet can be stably fed in the sheet conveying path L.

According to the present embodiment, the coupled section 27B is set in the position between the two tangent planes S1, S2 at all times regardless of the positions (see FIGS. 3 and 4) of the roller holder 25. If the sheet conveyer 23 is in a configuration to have the coupled section B outside the range between the tangent planes S1, S2 when the roller holder 25 is in the second position, a larger movable range is required for the sheet conveyer 23. However, according to the present embodiment, with the coupled section 27B established in the position between the two tangent planes S1, S2 at all times, the movable range for the sheet conveyer 23 can be downsized.

According to the present embodiment, the manipulation arm 27 extends from the roller holder 25 to the outside of the range of the sheet conveying path L (see FIG. 6). Further, the manipulation arm 27 is swingably supported at the swing axis 27A, which is inside the range of the sheet conveying path L. Meanwhile, the driving unit 29 supplies the driving force to the manipulation arm 27 at the position outside the range of the sheet conveying path L. Therefore, the manipulation arm 27 can firmly urge the pickup roller 23A against the recording sheet by an effect of leverage, and the recording sheet can be stably fed in the sheet conveying path L.

According to the present embodiment, the roller holder 25 is swingable about the axis of the drive shaft 23F, which transmits the driving force to the separator roller 23B (see FIG. 5). Meanwhile, the drive shaft 23F extends in the same direction as the manipulation arm 27 from the same side (e.g., the left side) with respect to the roller holder 25 to the separator roller 23B. In other words, the drive shaft 23F and the manipulation arm 27 are arranged on the same side with respect to the roller holder 25 (see FIG. 8). Therefore, space on the other side of the drive shaft 23F and the manipulation arm 27 across the roller holder 25 is left unoccupied. The unoccupied space may be used effectively to store other components in the chassis 3, and a volume of the sheet conveyer 23 may be reduced. Thus, the sheet conveyer 23 which can be downsized may be provided.

According to the present embodiment, whilst the drive shaft 23F and the manipulation arm 27 are arranged on the same side with respect to the roller holder 25, the drive shaft 23F and the driving unit 29 are commonly driven by the force supplied from the same drive source, i.e., the motor 31. Thus, a less complicated arrangement of the drive shaft 23F and the driving unit 29, compared to a sheet conveyer, which has the drive shaft 23F and the driving unit 29 being arranged on different sides across the roller holder 25, can be achieved even with regard to transmitting flows of the driving force.

According to the present embodiment, the pickup roller 23A is rotated by the driving force from the drive shaft 23F via the gear 25A, which is attached to the roller holder 25. Meanwhile, the gear 25A is arranged on the opposite side from the drive shaft 23F across the separator roller 23B within the roller holder 25 (see FIG. 8). Therefore, concern for interference of the gear 25A with the manipulation arm 27 can be eliminated. Thus, the gear 25A can be easily installed in the position between the pickup roller 23A and the separator roller 23B.

Figure 2:
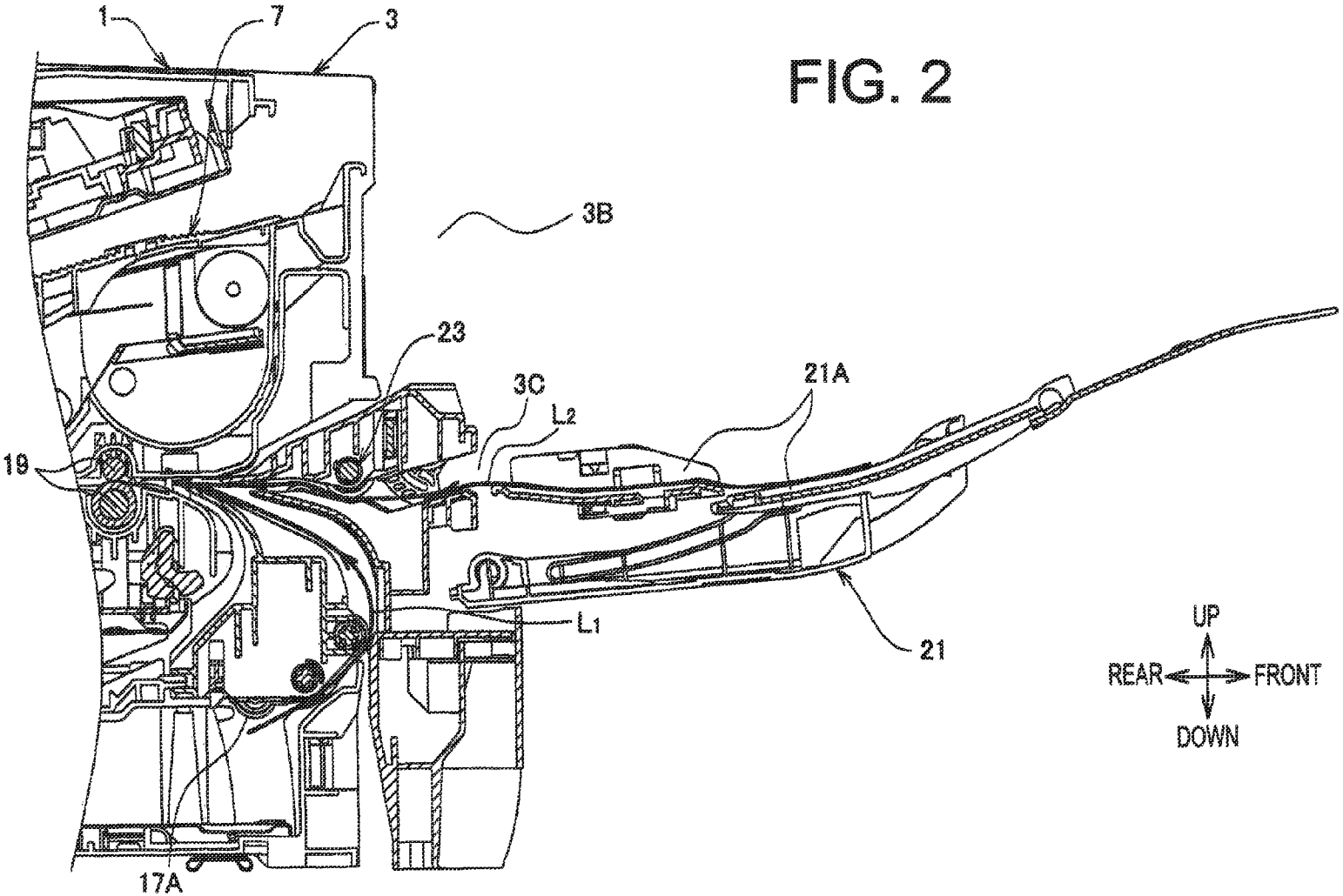
FIG. 2 is a cross-sectional partial view of the image forming apparatus 1 according to the embodiment of the present invention with a front cover being open.

According to the present embodiment, the opening 3B is formed in the position adjacent to the movable range of the roller holder 25 (see FIG. 2). Therefore, whilst the space required for the sheet conveyer 23 to move is reduced to be smaller, the image forming apparatus 1 can be downsized, and the opening 3B can be enlarged.

According to the present embodiment, the image forming apparatus 1 can be downsized without downsizing the processing cartridge 7. If the processing cartridge 7 is downsized, it may be necessary to reduce an amount of the developer agent to be contained therein. However, according to the present embodiment, a volume of the processing cartridge 7 can be maintained, and frequent exchange of the processing cartridges 7 can be prevented.

4. More Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the manipulation arm 27 may not necessarily be installed to be movable in the direction to intersect the tangent plane S2 but may be, for example, movable in a direction in parallel with the tangent planes S1 and S2.

For another example, the driving force from the drive shaft 23F to the pickup roller 23A may not necessarily be transmitted via the gear 25A but may be transmitted via, for example, a belt.

For another example, the sheet conveyer according to the present embodiment may not necessarily be employed in the electro-photographic image forming apparatus but may be employed in an image forming apparatus, which can form images in other image forming method. Further, the sheet conveyer may be employed in an auto document feeder in such image forming apparatuses.

What is claimed is:

1. A sheet conveyer device, which is configured to convey a sheet in a predetermined sheet conveying direction along a sheet conveying path, the sheet conveyer device comprising:

a sheet tray configured to store the sheet in a stack of sheets along a direction of thickness of the sheet;

a feeder roller configured to rotate in a position to contact the sheet and feed the sheet in the sheet conveying path;

a separator roller, which is arranged in a downstream position along the sheet conveying direction with respect to the feeder roller and configured to separate the fed sheet from the stack of sheets;

a roller holder configured to:

rotatably support the feeder roller and be coupled with the separator roller, spread from a separator roller side toward a feeder roller side over the separator roller and the feeder roller, and be movable between a first position, in which the feeder roller is in contact with the sheet in the sheet tray, and a second position, in which the feeder roller is apart from the sheet tray;

a manipulation arm configured to:

extend in a direction parallel to an axial direction of the feeder roller, be coupled to the roller holder, and manipulate the roller holder to move between the first position and the second position; and a driving unit configured to drive the manipulation arm to move the roller holder, wherein the manipulation arm is coupled to the roller holder at a coupled section, which is in a position between the feeder roller and the separator roller and in a position between two tangent planes which are common to the feed roller and the separator roller, wherein at least a portion of the manipulation arm extends, in the axial direction of the feeder roller, between the two tangent planes.

2. The sheet conveyer device according to claim 1, wherein the manipulation arm is configured to move in a direction to intersect at least one of the two tangent planes.

3. The sheet conveyer device according to claim 1, wherein the manipulation arm is configured to apply pressure toward the sheet tray to a section of the roller holder corresponding to an axial middle position of the feeder roller at least when the roller holder is in the first position.

4. The sheet conveyer device according to claim 1, wherein the coupled section is maintained in the position between the two tangent planes regardless of the positions of the roller holder.

5. The sheet conveyer device according to claim 4, wherein the manipulation arm is configured to extend from the roller holder beyond a range of the sheet conveying path and is swingably supported by a swing axis, the swing axis being arranged in a position corresponding to the sheet conveying path; and wherein the driving unit is configured to apply a driving force to the manipulation arm at a position beyond the range of the sheet conveying path.

6. The sheet conveyer device according to claim 1, wherein the roller holder is configured to be swingable about a drive shaft, the drive shaft configured to transmit a driving force to the separator roller; and wherein the drive shaft extends from a same side as the manipulation arm with respect to the roller holder to the separator roller.

7. The sheet conveyer device according to claim 6, wherein the drive shaft and the driving unit are configured to be driven by driving forces supplied from a same drive source.

8. The sheet conveyer device according to claim 6, wherein the feeder roller is configured to be rotated by the driving force from the drive shaft via a gear attached to the roller holder; and wherein the gear is arranged on a side opposite from the drive shaft across the separator roller within the roller holder.

9. An image forming apparatus, comprising:

a sheet conveyer device configured to convey a sheet in a predetermined sheet conveying direction along a sheet conveying path; and an image forming unit configured to form an image on the sheet being conveyed in the sheet conveying path by the sheet conveyer device, wherein the sheet conveyer device includes:

a sheet tray configured to store the sheet in a stack of sheets along a direction of thickness of the sheet;

a feeder roller configured to rotate in a position to contact the sheet and feed the sheet in the sheet conveying path;

a separator roller, which is arranged in a downstream position along the sheet conveying direction with respect to the feeder roller and configured to separate the fed sheet from the stack of sheets;

a roller holder configured to:

rotatably support the feeder roller and be coupled with the separator roller, spread from a separator roller side toward a feeder roller side over the separator roller and the feeder roller, and be movable between a first position, in which the feeder roller is in contact with the sheet in the sheet tray, and a second position, in which the feeder roller is apart from the sheet tray;

a manipulation arm configured to:

extend in a direction parallel with an axial direction of the feeder roller; configured to be coupled to the roller holder, and manipulate the roller holder to move between the first position and the second position; and a driving unit configured to drive the manipulation arm to move the roller holder; and wherein the manipulation arm is coupled to the roller holder at a coupled section, which is in a position between the feeder roller and the separator roller and in a position between two tangent planes which are common to the feed roller and the separator roller, wherein at least a portion of the manipulation arm extends, in the axial direction of the feeder roller, between the two tangent planes.

10. The image forming apparatus according to claim 9, wherein the image forming unit includes a processing cartridge, the processing cartridge configured to store a developer agent to be transferred onto the sheet;

wherein the processing cartridge is removably installable in a chassis of the image forming unit via an opening formed in the chassis; and wherein the opening is formed in a position adjacent to a movable range of the roller holder.

* * * * *